US007817811B2

(12) United States Patent
Umemura et al.

(10) Patent No.: US 7,817,811 B2
(45) Date of Patent: Oct. 19, 2010

(54) SOUND-ELECTRICITY CONVERSION DEVICE, ARRAY-TYPE ULTRASONIC TRANSDUCER, AND ULTRASONIC DIAGNOSTIC APPARATUS

(75) Inventors: Shinichiro Umemura, Muko (JP); Takashi Azuma, Kawasaki (JP); Tatsuya Nagata, Ishioka (JP); Hiroshi Fukuda, Tokyo (JP); Toshiyuki Mine, Fussa (JP); Syuntaro Machida, Kokubunji (JP)

(73) Assignee: Hitachi, Ltd., Tokyo (JP)

( * ) Notice: Subject to any disclaimer, the term of this patent is extended or adjusted under 35 U.S.C. 154(b) by 1269 days.

(21) Appl. No.: 11/341,655

(22) Filed: Jan. 30, 2006

(65) Prior Publication Data

US 2006/0284519 A1 Dec. 21, 2006

(30) Foreign Application Priority Data

Jun. 20, 2005 (JP) ..... 2005-179959

(51) Int. Cl.
*H04R 25/00* (2006.01)

(52) U.S. Cl. ..... 381/174; 381/189

(58) Field of Classification Search ..... 381/189
See application file for complete search history.

(56) References Cited

U.S. PATENT DOCUMENTS 6,320,239 B1 * 11/2001 Eccardt et al. ..... 257/415

FOREIGN PATENT DOCUMENTS

JP 2004-350702 12/2004
JP 2005-528010 9/2005
WO PCT/FR03/000427 8/2003

OTHER PUBLICATIONS

M. Haller and B.T. Khuri-Yakub, "A Surface Micromachined Electrostatic Ultrasonic Air Transducer" Proceedings of Ultrasonic Symposium, pp. 1241-1244, Nov. 1, 1994.

* cited by examiner

*Primary Examiner*—Curtis Kuntz
*Assistant Examiner*—Matthew Eason
(74) *Attorney, Agent, or Firm*—Antonelli, Terry, Stout & Kraus, LLP.

(57) ABSTRACT

The present invention aims to stabilize sound-electricity conversion characteristics of a diaphragm-type sound-electricity conversion device as well as to decrease the noise level of an ultrasonic diagnostic apparatus using the sound-electricity conversion device. The sound-electricity conversion device is configured by a capacitor cell including a lower electrode formed on a silicon substrate and an upper electrode over the lower electrode, the lower and upper electrodes sandwiching a cavity. An electrode short-circuit prevention film is formed on the upper electrode on the cavity side. The electrode short-circuit prevention film is formed of a material with an electrical time constant shorter than 1 second and longer than 10 microseconds, such as silicon nitride containing a stoichiometrically excessive amount of silicon. As a result, the electrode short-circuit prevention film has small electric conductivity, and thus it is made possible to prevent the film from being charged with electric charge and to avoid the drift of the electric charge. Consequently, the sound-electricity conversion characteristics of the sound-electricity conversion device stabilize, and further the sound noise level of the ultrasonic diagnostic apparatus decreases.

9 Claims, 6 Drawing Sheets

SOUND-ELECTRICITY CONVERSION DEVICE, ARRAY-TYPE ULTRASONIC TRANSDUCER, AND ULTRASONIC DIAGNOSTIC APPARATUS

CLAIM OF PRIORITY

The present application claims priority from Japanese application JP2005-179959 filed on Jun. 20, 2005, the content of which is hereby incorporated by reference into this application.

BACKGROUND OF THE INVENTION

1. Field of the Invention

The present invention relates to a diaphragm-type sound-electricity conversion device produced by using a semiconductor microfabrication technique, and an array-type ultrasonic transducer and an ultrasonic diagnostic apparatus using the sound-electricity conversion device.

2. Description of the Related Art

In the Early Twentieth Century, experiments started for transmitting/receiving ultrasonic sound by using piezoelectric effect of quartz crystal, when a problem arose in that a crystal has low electromechanical conversion efficiency. This prevented obtaining a sufficient sensitivity for, in particular, a receiving transducer and thus achieving its application to a practical product. Then, Rochelle salt was discovered having high electromechanical conversion efficiency, which was used to develop a sonar during the Second World War. However, the Rochelle salt had a problem in crystal stability such as being very deliquescent, requiring a special attention to obtain stable piezoelectric characteristics.

After the War, barium titanate was discovered having high electromechanical conversion efficiency as well as stable piezoelectric effect. Being ceramic, barium titanate advantageously had a high degree of freedom in shape design, which led to creating the concept of "piezoelectric ceramic". Then in the Late Twentieth Century was discovered lead zirconate titanate (PZT) ceramic having higher Curie point as well as even more stable piezoelectric effect than barium titanate. The emergence of PZT ceramic allowed obtaining a piezoelectric device with high sensitivity and stability. Thereafter, the piezoelectric device using PZT ceramic came to be widely used for, for example, ultrasonic transducers, as is found today.

The material replacement of the ultrasonic transducer from quartz crystal to the piezoelectric ceramic was advantageous in impedance matching in the accompanying replacement of electric circuits such as a receiving amplifier and a transmission drive circuit from vacuum tubes to semiconductors. However, the replacement of electric circuits including a drive circuit to semiconductors required meeting requirements in high voltage and high frequency operation, for example. Thus, it was necessary to wait for practical use of high-speed thyristors and highly resistant Field Effect Transistors (FETs). After the replacement to semiconductors was realized in electric circuits around the ultrasonic transducers, it was in the 1990s that studies started for forming a diaphragm-type ultrasonic transducer employing a semiconductor micro fabrication technique. The realization of such a semiconductor ultrasonic transducer using semiconductors allows forming an ultrasonic transducer and its peripheral circuits by a series of semiconductor fabrication processes, and therefore, notable effects can be expected in both production cost and performance of ultrasonic receivers.

A non-patent document by M. Haller and B. T. Khuri-Yakub, "A Surface Micromachined Electrostatic Ultrasonic Air Transducer", Proceedings of Ultrasonic Symposium, pp. 1241-1244, 1 Nov. 1994, discloses an example of a sound-electricity conversion device in a diaphragm-type ultrasonic transducer produced with a semiconductor microfabrication technique. The sound-electricity conversion device has a basic structure in which an impurity-doped silicon substrate has on its top a cavity, a diaphragm of a silicon nitride film is formed opposite to the silicon substrate, the diaphragm and the substrate sandwiching the cavity, and further an electrode layer is formed on the surface or inside of the diaphragm on the cavity side.

That is, the basic structure of the sound-electricity conversion device was a capacitor having the silicon substrate as a lower electrode and the electrode layer formed on the diaphragm side as an upper electrode. Therefore, applying a voltage between these electrodes induces opposite electric charges on the electrodes, the charges attracting to each other and thereby displacing the diaphragm. At this time, if the diaphragm contacts on the outside with water or an organism, it radiates sound wave via the water or organism as a medium. Also, by applying a DC bias voltage on the electrode to induce thereon certain electric charge, and then forcibly applying vibration to the electrode from the medium contacting with the diaphragm, i.e., displacing the diaphragm, an additional voltage occurs between the electrodes depending on the displacement amount. This is the principle of sound-electricity conversion of the diaphragm-type ultrasonic transducer as shown in the above-cited non-patent document by M. Haller and B. T. Khuri-Yakub. The principle of sound-electricity conversion in ultrasonic reception is the same as the principle of a DC bias type capacitor microphone used as an audible sound range microphone.

The sound-electricity conversion device as discussed above has a diaphragm structure with a space on the back surface and therefore can obtain a good sound impedance matching to a mechanically soft material such as water and an organism, even if the device is configured with a mechanically hard material such as silicon. Also, because the sound-electricity conversion device is formed on the silicon substrate, it is possible to integrally form an ultrasonic transmission/reception circuit for driving the device on the same or closely arranged silicon substrate.

Thereafter, further studies and developments were made for the diaphragm-type ultrasonic transducer, which now has reached a level comparable with a piezoelectric type transducer using PZT in terms of, for example, transmission/reception sensitivity, although the basic structure and operation principle of the transducer have not greatly changed.

In a diaphragm-type ultrasonic transducer, in order to maximize its conversion efficiency, its electrodes are applied with a DC bias voltage of a magnitude that displaces the diaphragm close to contacting a silicon substrate so as to induce as much electric charge as possible. With this, the electrode on the diaphragm side easily contacts the silicon substrate. However, in practice, when the electrode on the diaphragm side contacts or come close to contacting the silicon substrate, a short-circuit occurs causing an excessive current flow or discharging phenomenon between the electrodes. In this occurrence, the excessive current, for example, may destroy the sound-electricity conversion device itself or the peripheral circuit system connected to the device.

Therefore, the current sound-electricity conversion device typically has a design in which at least one of the electrodes on the diaphragm and substrate sides is provided, on the cavity side, with an electrode short-circuit prevention film made from an insulation film. This electrode short-circuit prevention film can prevent a short-circuit or a discharge phenomenon from occurring between the electrodes, even when the electrode on the diaphragm side contacts the silicon substrate.

Such an electrode short-circuit prevention film is often formed of a silicon nitride film which is often formed by vapor phase epitaxy typified by CVD (Chemical Vapor Deposition). However, the silicon nitride film formed by CVD includes more coupling deficiencies than, for example, a silicon oxide film formed by thermal oxidation, and therefore is characteristically subject to electrification when applied with a high voltage. In addition, the amount of electric charge electrified drifts depending on the applied voltage value and with the passage of time, and does not stabilize.

That is, in a sound-electricity conversion device provided with an electrode short-circuit prevention film such as a CVD nitride film, such an unstable electric charge would occur between the capacitor electrodes indispensable to construct the principle of sound-electricity conversion. Therefore, even if the same voltage is applied between the electrodes or if the diaphragm electrodes are displaced by the same amount, the amount of electric charge induced in the electrodes would change and drift. This causes the sound-electricity conversion characteristics of the sound-electricity conversion device to drift and become unstable.

The drift of the sound-electricity conversion characteristics has a critical effect on the characteristics of an array-type ultrasonic transducer constructed by arranging many of such sound-electricity conversion devices. This is because when the sound-electricity conversion characteristics of each of the devices constructing the array-type ultrasonic transducer drift independently, the entirety of an ultrasonic diagnostic apparatus using the array-type ultrasonic transducer experiences a considerable increase in the sound noise level when forming transmission and reception beams. As discussed above, the ultrasonic transducer using the semiconductor diaphragm type sound-electricity conversion device has not sufficiently solved the problems of sensitivity and stability.

In view of the above-mentioned problems in the prior art, the present invention aims to stabilize the sound-electricity conversion characteristics of the sound-electricity conversion device provided with the electrode short-circuit prevention film, and to decrease the sound noise level of the ultrasonic transducer as well as the ultrasonic diagnostic apparatus configured by the sound-electricity conversion device.

SUMMARY OF THE INVENTION

To achieve the above mentioned purpose, the present invention adds weak electric conductivity to an electrode short-circuit prevention film. That is, a sound-electricity conversion device according to the invention is a diaphragm-type sound-electricity conversion device comprising:

a first electrode formed on a silicon substrate; and a second electrode formed over and opposite to the first electrode, the first and second electrodes sandwiching a cavity, wherein:

an electrode short-circuit prevention film is formed on the side of the cavity of at least one of the first and second electrodes;

the electrode short-circuit prevention film has weak electric conductivity, the electric conductivity being defined by an electrical time constant (=(dielectric constant/electric conductivity)$^{1/2}$) which is sufficiently shorter than a rising time of a power voltage supplied to the electrode short-circuit prevention film and is sufficiently longer than a vibration cycle of a sound wave to be converted by the sound-electricity conversion device. More particularly, the electrical time constant of the electrode short-circuit prevention film is shorter than 1 second, and longer than 10 microseconds.

According to the invention, by forming the electrode short-circuit prevention film with a material with an electrical time constant which is, for example, shorter than 1 second and longer than 10 microseconds, weak electric conductivity can be added to the electrode short-circuit prevention film. With such weak electric conductivity, the electrode short-circuit prevention film operates as a dielectric in a time scale in an ultrasonic operation range, and as an electric conductor in a time scale approximately of the rising time when the power is turned on. That is, in the latter time scale, the electrode short-circuit prevention film is quickly electrified with, and quickly discharges, electric charges. This prevents an occurrence of a phenomenon in which the electric charges charged in the electrode short-circuit prevention film will drift. As a result, the sound-electricity conversion characteristics of the sound-electricity conversion device on which is provided the electrode short-circuit prevention film stabilizes, and the sound noise level of the ultrasonic diagnostic apparatus configured by using the sound-electricity conversion device decreases.

The electrode short-circuit prevention film is characteristically formed of a silicon nitride film containing a stoichiometrically excessive amount of silicon.

By introducing an excessive amount of silicon to silicon nitride, which is a stoichiometrically stable insulation material, the silicon has an excess of bonds which serve as movement media for electric charges, resulting in small electric conductivity. In other words, the electrode short-circuit prevention film having small electric conductivity can be realized with silicon nitride containing an stoichiometrically excessive amount of silicon.

Thus, the present invention stabilizes the sound-electricity conversion characteristics of the sound-electricity conversion device provided with the electrode short-circuit prevention film, and decreases the noise level of the ultrasonic diagnostic apparatus configured using the sound-electricity conversion device.

DESCRIPTION OF THE PREFERRED EMBODIMENT

Figure 1:
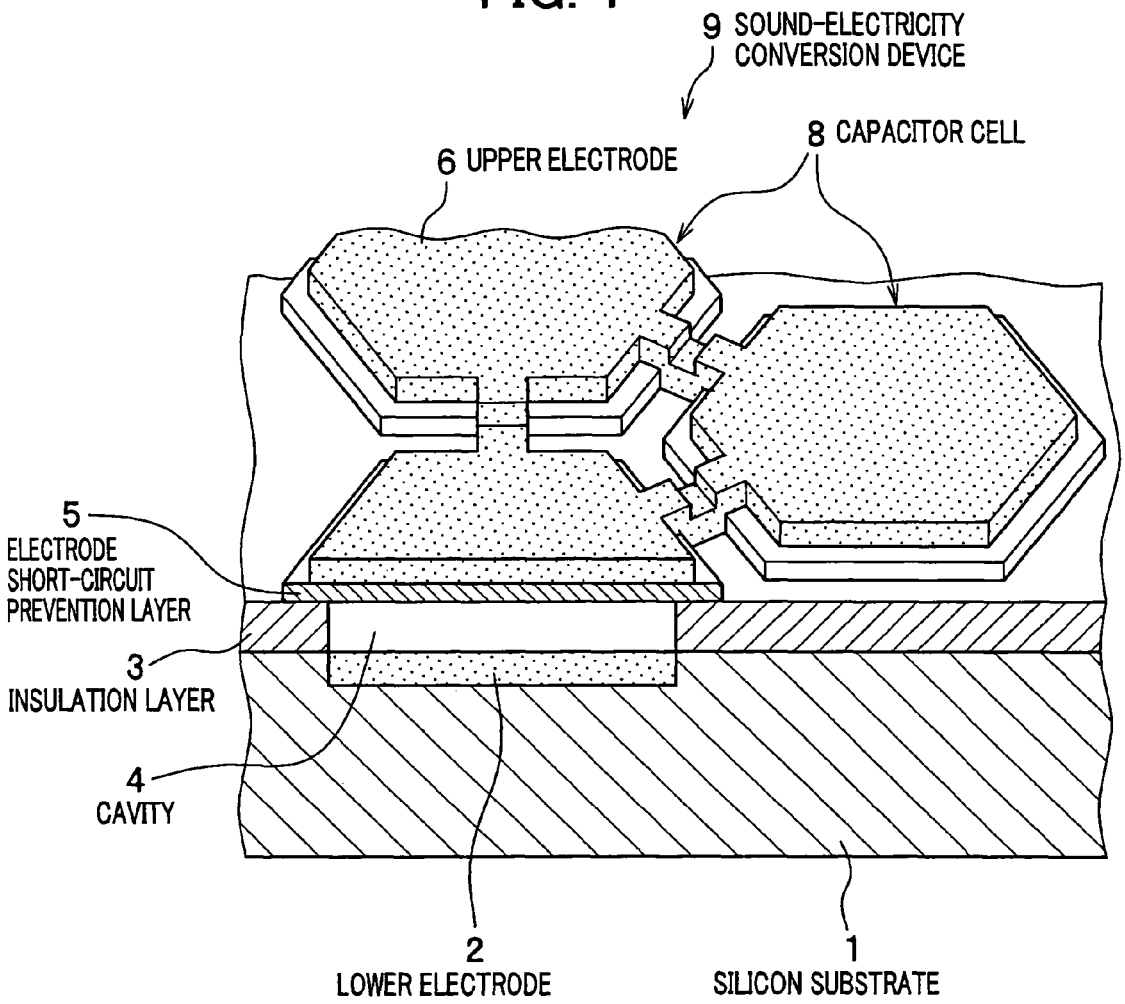
FIG. 1 is a drawing to show a structural concept of a semiconductor diaphragm type sound-electricity conversion device according to an embodiment of the present invention.

Referring to the drawings, an embodiment of the present invention will be described in detail below.

Figure 2:
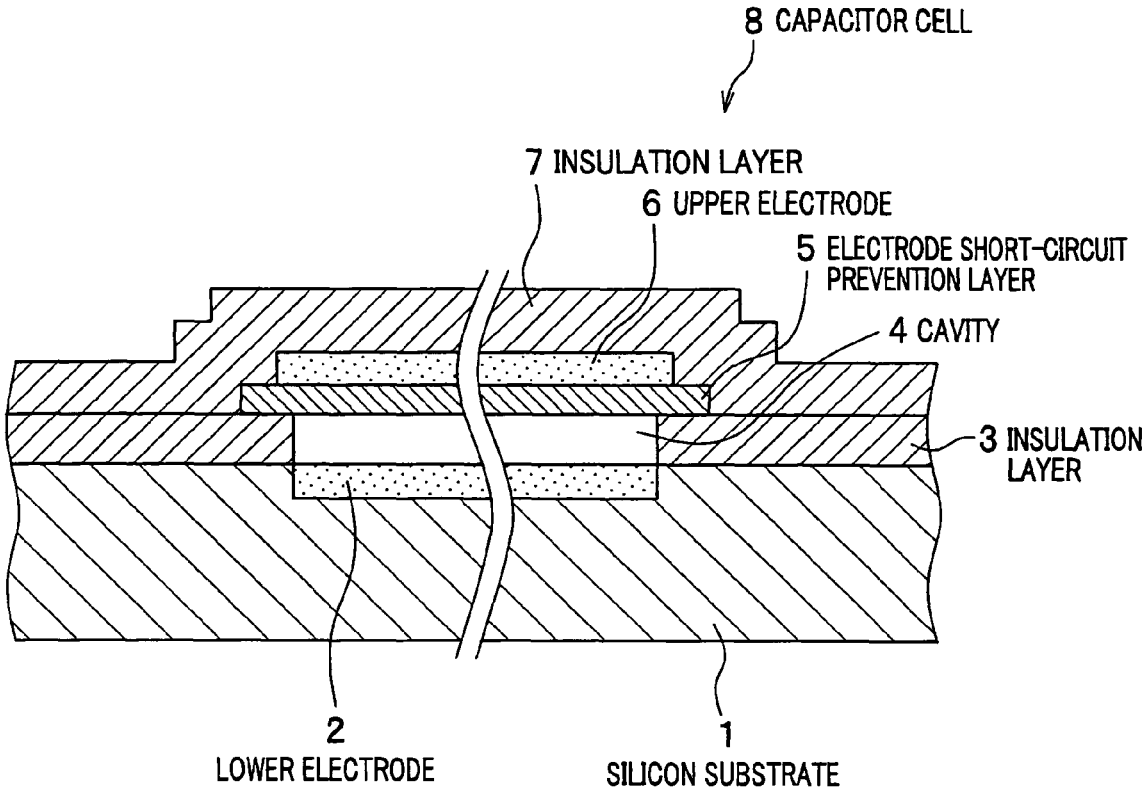
FIG. 2 is a drawing to show a sectional structure of a capacitor cell as a unitary constructional element of the sound-electricity conversion device as shown in FIG. 1.

FIG. 1 is a drawing to show a structural concept of a semiconductor diaphragm type sound-electricity conversion device according to an embodiment of the present invention. FIG. 2 is a drawing to show a sectional structure of a capacitor cell as a unitary constructional element of the sound-electricity conversion device.

As shown in FIG. 1, the sound-electricity conversion device 9 is configured with a plurality of capacitor cells 8 that are two-dimensionally arranged in a honeycomb shape on a silicon substrate 1. Each of the capacitor cells 8 is a capacitor comprising a lower electrode 2 formed on the silicon substrate 1 and an upper electrode 6 formed opposite to the lower electrode 2, the upper and lower electrodes sandwiching a cavity 4.

The upper electrode 6 flexes toward the lower electrode 2 when applied with a pressure, i.e., sound pressure, from the side of the upper electrode 6 or when a voltage is applied between the upper and lower electrodes 6, 2. The principle of sound-electricity conversion in the sound-electricity conversion device 9 is based on the relationship between the displacement amount of the upper electrode 6 caused by the flexure and the amount of electric charge or voltage change caused by the flexure. A detailed discussion on the relationship will be given later.

As shown in FIGS. 1 and 2, on the upper electrode 6 on the side of the cavity 4 is formed an electrode short-circuit prevention film 5 for preventing the upper electrode 6 from contacting and shortcircuiting with the lower electrode 2 when the upper electrode 6 flexes toward the lower electrode 2. Also, as shown in FIG. 2 (not shown in FIG. 1), on the top of the lower electrode 2 is formed an insulation layer 7 which mechanically and structurally supports the upper electrode 6. That is, the insulation layer 7 constructs the main body of the diaphragm of the sound-electricity conversion device 9. The insulation layer 7 also serves to protect the entire sound-electricity conversion device 9 from the external environment.

Next, referring to FIG. 2, a detailed discussion on the sectional structure of the capacitor cell 8 constructing the sound-electricity conversion device 9 will be presented.

As shown in FIG. 2, the capacitor cell 8 is formed on, for example, an n-type silicon substrate 1 which is doped with an n-type impurity and is thereby provided with electric conductivity. Typically, the silicon substrate 1 also serves as the lower electrode 2, and the portion of which as shown in the drawing is often formed to have a high impurity concentration in order to increase the electric conductivity.

On the silicon substrate 1 is formed an insulation layer 3 made of, for example, silicon nitride ($Si_3N_4$) with a width of about 100 nm. The insulation layer 3 is removed in one part providing a cavity 4. The cavity 4 therefore has a width of about 100 nm, as well as a two-dimensional hexagonal shape and an inside diameter of about 50 μm.

On the insulation layer 3 and the cavity 4 is formed the electrode short-circuit prevention film 5 made of silicon nitride (($Si_3N_4$)xSi1-x) containing a stoichiometrically excessive amount of silicon (preferably $0.7<x<0.95$). The prevention film 5 has a width of about 100 nm. Although silicon nitride is typically an insulation material, the silicon nitride containing a stoichiometrically excessive amount of silicon can provide small electric conductivity. The effect of this small electric conductivity will be discussed later.

On the electrode short-circuit prevention film 5 is formed the upper electrode 6 made of, for example, aluminum with a width of about 100 nm. Further, on the upper electrode 6 is formed the insulation layer 7 made of, for example, silicon nitride ($Si_3N_4$). The insulation layer 7 has a width of about 1500 nm, and serves as a layer to supplement the mechanical strength of the sound-electricity conversion device 9. That is, when a voltage is applied between the upper and lower electrodes 6, 2, or when an external pressure is applied on the insulation layer 7, the electrode short-circuit prevention film 5, the upper electrode 6, and the insulation layer 7 integrally flex, thereby constructing a so-called diaphragm.

Now, with reference to FIGS. 3 to 5, an estimation will be given of the electrical characteristics of the capacitor having the electrode short-circuit prevention film 5 formed between the upper and lower electrodes 6, 2.

Figure 3:
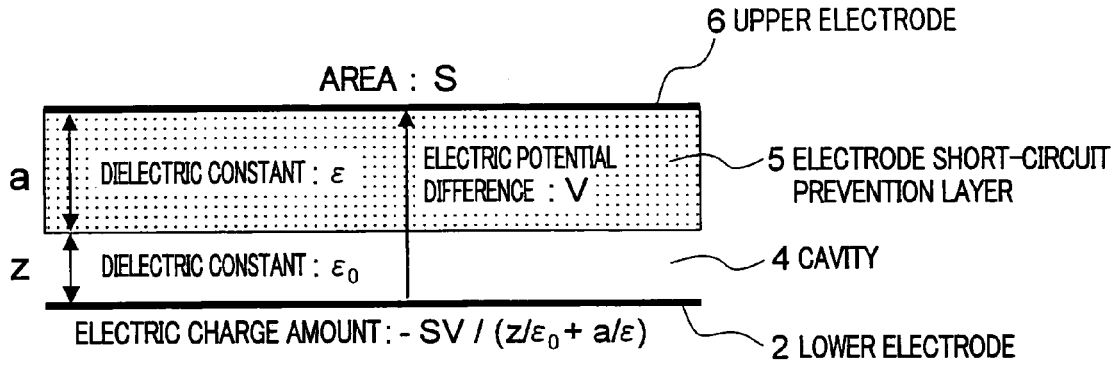
FIG. 3 is a drawing to show an exemplary electrical model of a capacitor constructed with upper and lower electrodes sandwiching a cavity and an electrode short-circuit prevention film.
Figure 4:
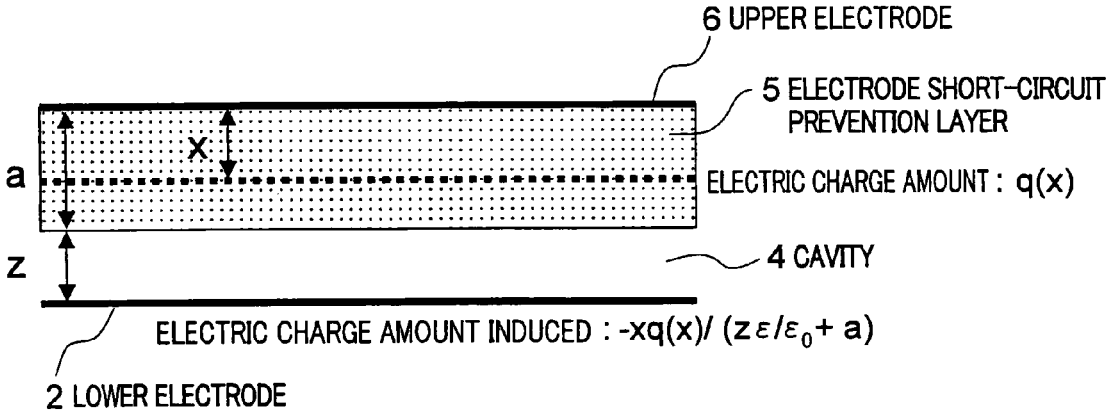
FIG. 4 is a drawing to show an exemplary electrical model of a capacitor with the same construction as FIG. 3 wherein the electrode short-circuit prevention film is charged with electric charge.
Figure 5A:
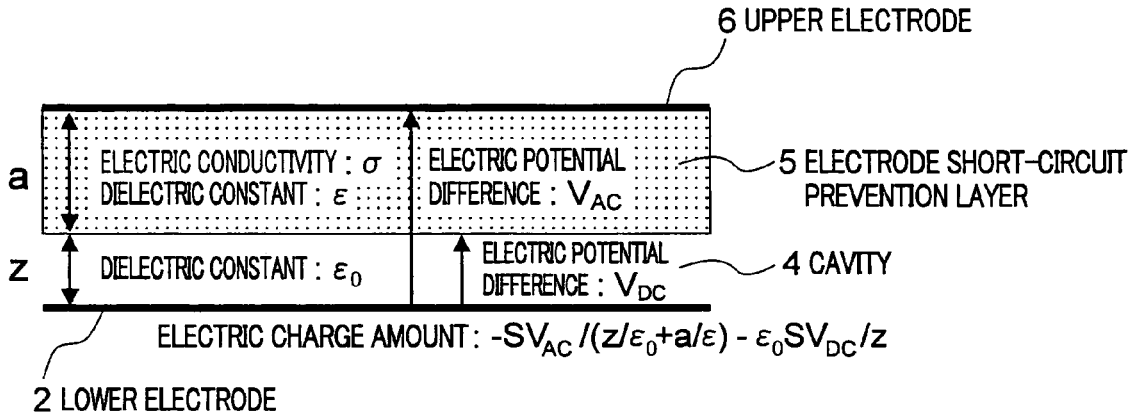
FIG. 5A is a drawing to show an exemplary electrical model of a capacitor with the same construction as FIG. 3 wherein the electrode short-circuit prevention film is provided with weak electric conductivity.
Figure 5B:
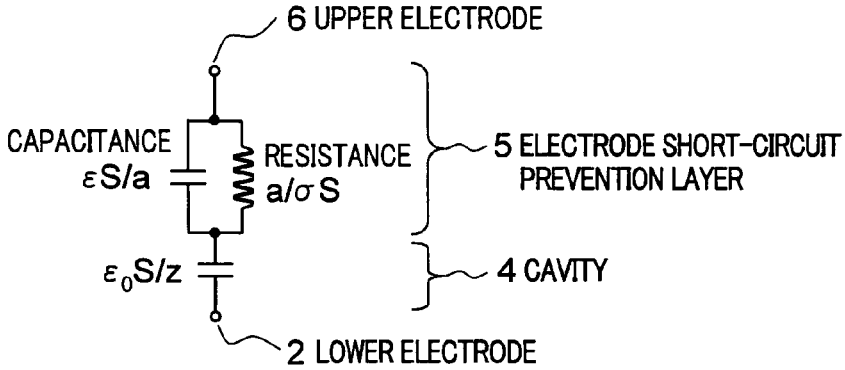
FIG. 5B is a drawing to show an equivalent circuit of the electrical model as shown in FIG. 5A.

FIG. 3 is a drawing to show an exemplary electrical model of the capacitor constructed with the upper and lower electrodes sandwiching the cavity and the electrode short-circuit prevention film. FIG. 4 is a drawing to show an exemplary electrical model of a capacitor with the same construction as FIG. 3 wherein the electrode short-circuit prevention film is charged with electric charge. FIG. 5A is a drawing to show an exemplary electrical model of the capacitor with the same construction as FIG. 3 wherein the electrode short-circuit prevention film is provided with weak electric conductivity. FIG. 5B is a drawing to show an equivalent circuit of the electrical model as shown in FIG. 5A.

FIG. 3 considers the capacitor constructed with the upper and lower electrodes 6, 2 as an ideal parallel plate capacitor with an electric capacity given by $S/(z/\in_0+a/\in)$, wherein $\in$ is the dielectric constant of the electrode short-circuit prevention film 5 contacting the upper electrode 6, a is the width of the electrode short-circuit prevention film 5, $\in_0$ is the vacuum dielectric constant, z is the width of the cavity 4, and s is the area of the electrode. If a voltage V is applied between the upper and lower electrode 6, 2 (V is the voltage of the upper electrode 6 with respect to the lower electrode 2), in the lower electrode 2 is charged an electric charge in an amount given by $-SV/(z/\in_0+a/\in)$.

At this time, the electric field at the position of the lower electrode 2 is directed downward with a strength given by $V/(z+a\in_0/\in)$. Therefore, to the lower and upper electrode 2, 6 are applied upward and downward strengths, respectively, both calculated as $\in_0 SV^2/(z+a\in_0/\in)^2$. In other words, the strength applied between the upper and lower electrodes 6, 2 is proportionate to the square of the applied voltage V, and is in inverse proportion to the square of the distance between the electrodes ($z+a\in_0/\in$) corrected with the dielectric constant. Accordingly, in order to obtain a great force using the same applied voltage, the width a of the electrode short-circuit prevention film 5 and the width z of the cavity 4 should be made small to the extent not obstructing the capacitor operation.

Next will be discussed the effect by the electrode short-circuit prevention film 5 charged with electric charge. If the amount of electric charge charged at the position away from the upper electrode 6 by the distance x is provided as q(x) as shown in FIG. 4, then the amount of electric charge induced at the lower electrode 2 by the electric charge amount q(x) is given by $-xq(x)/(z\in/\in_0+a)$. Therefore, the total amount of electric charge Qz charged in the lower electrode 2 can be expressed by equation 1 below.

$$Q_z=-\int xq(x)dx/(z\in/\in_0+a) \quad (1)$$

Here, if a voltage V is applied between the upper and lower electrodes 6, 2, then the force $F_q$ to be applied on Qz is directed upward and can be expressed by equation 2.

$$F_q=\in_0 V\int xq(x)dx/\in/(z+a\in_0/\in)^2 \quad (2)$$

Accordingly, the total force Fa to be applied on the lower electrode 2 is directed upward and can be expressed by equation 3, which is obtained by adding the force obtained by equation 2 to the force obtained by FIG. 3.

$$F_a=\in_0 V(SV+\int xq(x)dx/\in)/(z+a\in_0/\in)^2 \quad (3)$$

Thus, if the electric charge q(X) and V match in symbol, then a force will occur which is larger by Fq compared to when the electric charge q(x) is not charged, even if the same voltage V is applied between the upper and lower electrodes 6, 2. At this time, if the electric charge q(x) is stable, then the force occurring by the electric charge q(x) can be advantageously utilized.

However, electric charge q(x) occurring in, for example, a typical CVD silicon nitride film drifts in time. Therefore, the force occurring between the upper and lower electrodes 6, 2 is also caused to drift because of the drift of the electric charge q(x), even if the same voltage V is applied between the upper and lower electrodes 6, 2. In other words, the drift of the sound-electricity conversion characteristics of the sound-electricity conversion device 9 considerably damages the usefulness of an ultrasonic transducer using the characteristics.

To counter this problem, in the present embodiment, the electrode short-circuit prevention film 5 is formed with the silicone nitride containing a stoichiometrically excessive amount of silicon so as to provide the prevention film 5 with small electric conductivity as discussed above. Then, the range of the small electric conductivity is determined in light of the operation status of the ultrasonic diagnostic apparatus to which the sound-electricity conversion device 9 is mainly applied.

In general, all physical materials except superconducting materials can be electrically conductive in some time scales, while in other time scales dielectric. Whether a physical material behaves as a dielectric or electrically conducting material in a time scale depends on the ratio between the dielectric constant and the electric conductivity of the material. For example, quartz glass having characteristics of:

Dielectric Constant: $\in\approx 3.8\times 8.85$ pF/m$\approx$34 pF/m; and

Electric Conductivity: $\sigma\approx 10^{-17}/\Omega$m behaves as a dielectric or an electric conductor in a sufficiently shorter or longer time scale, respectively, compared with:

Time Constant: $\tau=(\in/\sigma)^{1/2}\approx$1800 seconds=30 minutes.

The sound-electricity conversion device 9 according to the present embodiment is mainly applied to the ultrasonic diagnostic apparatus (ultrasonic tomographic image generating apparatus) that transmits and receives pulse-shaped ultrasonic wave to generate an image in an organism, typically a human body. The list below shows in the order of length of time the timescales for operations included in the ultrasonic diagnostic apparatus.

| | |
|---|---|
| (1) Ultrasonic cycle: | 0.1-1 μsec |
| (2) Ultrasonic pulse length: | 0.3-3 μsec |
| (3) Repeating cycle of pulse transmission: | 0.1-1 msec |
| (4) Image generating (frame) cycle: | 10-100 msec |
| (5) Image generating mode switching time: | 0.1-10 sec |
| (6) Power rising time: | 10-100 sec |

In the sound-electricity conversion device 9 according to the present invention, the time scale for a AC voltage $V_{AC}$ applied between the upper and lower electrodes 6, 2 is determined by (1) ultrasonic cycle, and the time scale for the time-change of a DC bias voltage $V_{DC}$ is determined by (6) power rising time. Accordingly, by setting the time constant τ of the electrode short-circuit prevention film 5 to be sufficiently longer and shorter than (1) ultrasonic cycle and (6) power rising time, respectively, the electrode short-circuit prevention film 5 stably behaves as a dielectric and an electric conductor for the applied AC voltage $V_{AC}$ and the DC voltage $V_{DC}$, respectively.

Therefore, the present embodiment considers the sound-electricity conversion device 9 to be used for an ultrasonic transducer such as an ultrasonic tomographic image generating apparatus, and sets the electric time constant τ of the electrode short-circuit prevention film 5 to be sufficiently longer and shorter than (1) ultrasonic cycle and (6) power rising time, respectively. That is, the electrode short-circuit prevention film 5 is provided with small electric conductivity with a time constant τ longer than 10 μsec and shorter than 1 sec.

Next, referring to FIG. 5A will be discussed an exemplary electrical model of a capacitor wherein the electrode short-circuit prevention film 5 is provided with small electric charge as mentioned above. As FIG. 5A shows, between the upper and lower electrodes 6, 2 is applied the AC voltage $V_{AC}$ such as an ultrasonic pulse wave. In this case, in the capacitor, the electrode short-circuit prevention film 5 operates as a dielectric with respect to the AC voltage $V_{AC}$, and therefore the distance between the electrodes of the capacitor is the total (z+a) of the width z of the cavity 4 and the width a of the electrode short-circuit prevention film 5. For the DC bias voltage $V_{DC}$, which has a very long (infinite) scale of time-change, the electrode short-circuit prevention film 5 operates as an electric conductor. Thus, the effective distance between the electrodes with respect to the DC bias voltage $V_{DC}$ in the capacitor is the width z of the cavity 4.

In other words, the capacitor as shown in FIG. 5A has a construction in which two capacitors are connected in parallel, one operating in response to the AC voltage $V_{AC}$ and the other operating in response to the DC voltage $V_{DC}$. Accordingly, the amount of electric charge induced in the lower electrode 2 is the total of the electric charge amount induced by the AC voltage $V_{AC}$ and that induced by the DC bias voltage $V_{DC}$.

In FIG. 5A, the electric charge amount induced in the lower electrode 2 by the AC voltage $V_{AC}$ can be calculated in the similar manner as in the electrical model of the capacitor in FIG. 3, and is given by $$-SV_{AC}/(z/\in_0+a/\in).$$

The electric charge amount induced by the DC bias voltage $V_{DC}$ is given by $$-\in_0 SV_{DC}/z.$$

Thus, the total electric charge induced by the lower electrode 2 of the capacitor is given by $$-SV_{AC}/(z/\in_0+a/\in)-\in_0 SV_{DC}/z.$$

Accordingly, the electric field strength at the position of the lower electrode 2 is directed downward and is given by $$V_{DC}/z+V_{AC}/(z+a\in_0/\in).$$

Thus, the force applied to the lower electrode 2 is directed downward and given by $$\in_0 S[V_{DC}/z+V_{AC}/(z+a\in_0/\in)]^2.$$

In addition, the electrode short-circuit prevention film 5 provided with electric conductivity functions as a resistor with a resistance value of $a/\sigma S$, as shown in the equivalent circuit of FIG. 5B. Therefore, the impedance of the capacitor shown in FIG. 5A can be expressed by equation 4 or 5 presented below. The equation 5 is a simplified expression of the equation 4.

$$-jz[1/(\omega\in+\sigma^2/\omega\in)+1/\omega\in_0]/S+a\sigma/(\sigma^2\in^2+\sigma^2)/S \quad (4)$$

$$=z/\omega S\{-j[1/(\in+\sigma^2/\omega^2\in)+1/\in_0]+(a/z)\omega\sigma/(\omega^2\in^2+\sigma^2)\} \quad (5)$$

Wherein, j is the imaginary number unit, and ω is the angular frequency of the driving voltage or current. For the purpose of simplicity, the term for expressing the effect of the sound-electricity conversion is omitted.

The second term of the equation 4 is the real-number portion of the device impedance. The second term in the curly parenthesis of equation 5 that corresponds to the second term of the equation 4 is an approximate expression of the relative magnitude of the power loss due to the provision of the electric conductivity to the electrode short-circuit prevention film 5. The second term of equation 5 has the maximum value of $(a/2z)/\in$ when $\omega=\sigma/\in$. Therefore, if the angular frequency ω of the electric signal is close to this $\sigma/\in$, then the power loss due to the provision of the electric conductivity to the electrode short-circuit prevention film 5 increases. This means that the $\sigma/\in$ of the electrode short-circuit prevention film 5 should be set to be sufficiently small or large with respect to the angular frequency used by the capacitor. That is, in the present embodiment, because the capacitor is used as the sound-electricity conversion device 9 that handles ultrasound of relatively high frequency (1-10 MHz), it is realistic to set the $\sigma/\in$ of the electrode short-circuit prevention film 5 to be sufficiently smaller than the ultrasonic frequency.

As discussed above, by setting the electrical time constant τ of the electrode short-circuit prevention film 5 to 10 or more μseconds and 1 or less seccond, the electrode short-circuit prevention film 5 operates as a dielectric and an electric conductor in the time scales of the ultrasonic pulse and the power rising time, respectively. Also, the electric power loss is also decreased. Thus, the sound-electricity conversion device 9 as well as the array-type ultrasonic transducer with stable characteristics can be obtained.

It is to be noted that in the present embodiment, the electrical time constant τ of the electrode short-circuit prevention film 5 has the minimum value of 10 μseconds, as a result of setting the minimum value to be sufficiently larger by ten times than the "ultrasonic cycle: 0.1-1 μsecond" typically used for an ultrasonic diagnostic apparatus. Accordingly, if the ultrasonic cycle typically used in the ultrasonic diagnostic apparatus may change in the future, the minimum value for the electrical time constant τ of the electrode short-circuit prevention film 5 may be set to a value ten times the ultrasonic cycle typically used in the ultrasonic diagnostic apparatus.

Next, an exemplary method for producing the electrode short-circuit prevention film 5 will be described. The electrode short-circuit prevention film 5 is made of silicon nitride $Si_3N_4$ containing a stoichiometrically excessive amount of silicon as mentioned above. Such a silicon nitride film can be obtained by forming a film by means of the CVD method that uses a mixture gas of silane $SiH_4$ and ammonia $NH_3$, and typically has a composition ratio of $(Si_3N_4)_{0.8}Si_{0.2}$. The composition ratio can be controlled by changing the mixture ratio of silane $SiH_4$ and ammonia $NH_3$. With this composition ratio, the dielectric constant, electric conductivity, and time constant determined by these have following values.

Dielectric Constant: $\in\approx 8\times 8.85$ pF/m≈100 pF/m

1/Electric Conductivity: $1/\sigma\approx 1$ MΩm

Time Constant: $\tau=(\in/\sigma)^{1/2}\approx 10$ msec

This time constant is preferable for the purpose of using the sound-electricity conversion device as the basic unit to construct the array-type ultrasonic transducer used for the ultrasonic diagnostic apparatus, as discussed above.

By the composition ratio of silicon nitride and silicon, the electric conductivity changes significantly but the dielectric constant does not. In order to set the time constant τ to 10 or more μseconds and 1 or less second, it is preferable to set x in $(Si_3N_4)xSi1\text{-}x$ to $0.7<x<0.95$. Although the present embodiment uses silicon nitride containing a stoichiometrically excessive amount of silicon as the material for the electrode short-circuit prevention film 5, other materials having a similar time constant may also be used.

The electrode short-circuit prevention film 5 was originally provided for the purpose of preventing an excessive current from occurring when the cavity 4 is crushed and the upper and lower electrodes 6, 2 contact to each other so as to prevent the peripheral drive circuits, for example, from being destroyed. In the present embodiment, the electrode short-circuit prevention film 5 is provided with small electric conductivity in the order of the time constant in the range mentioned above. Following discussion will indicate that the contact between the upper and lower electrodes 6, 2 will not cause any excessive current flow and therefore any destruction of the peripheral drive circuits, for example.

Typically, the array-type ultrasonic transducer used for the ultrasonic diagnostic apparatus is configured by arranging the sound-electricity conversion device 9 into an array. The sound-electricity conversion device 9 is a plurality of capacitor cells 8 connected in parallel, constructing one electrically independent device. The electrode short-circuit prevention film 5 according to the embodiment has a width of 100 nm, and therefore its electric resistance per area is approximately 1 MΩm×100 nm=0.1 $\Omega m^2$. Also, because the ultrasonic frequency most used in the ultrasonic diagnostic apparatus is several MHz, the capacitor portion of the sound-electricity conversion device has an area in the order of 1 $mm^2$. Therefore, when the cavity 4 is crushed and the upper and lower electrodes 6, 2 come into contact by the whole surface thus minimizing the resistance, the magnitude of the shunt resistance is in the order of 0.1 $\Omega mm^2\times 1\ mm^2$=100 kΩ. This is sufficient to prevent the peripheral circuits such as the drive circuit and wirings from being damaged by the shunt current. Thus, the contact between the upper and lower electrodes 6, 2 will not cause any excessive current flow and therefore any destruction of peripheral circuits, for example.

Figure 6:
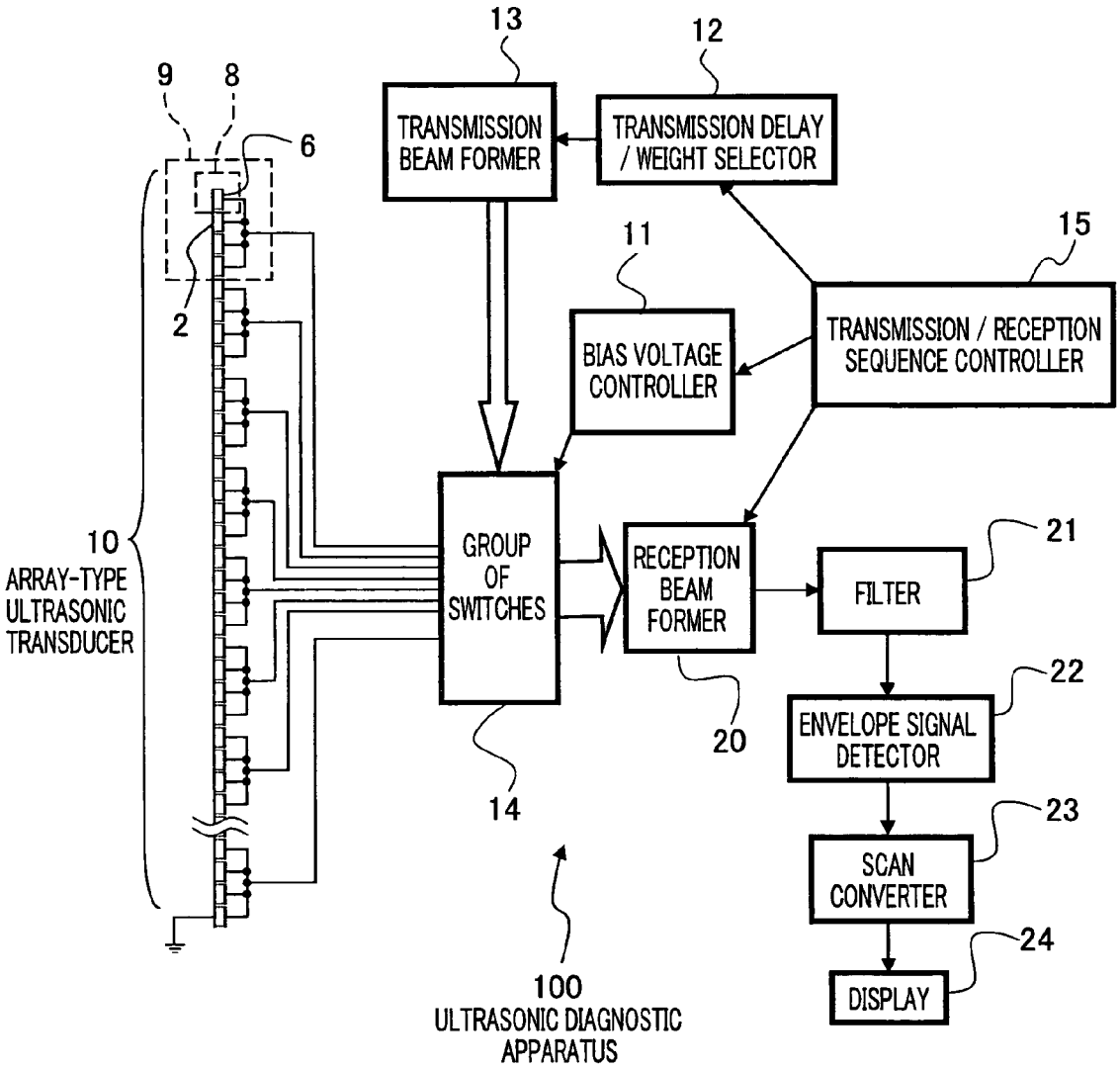
FIG. 6 is a drawing to show an exemplary construction of an ultrasonic diagnostic apparatus using an array-type ultrasonic transducer constructed by arranging many sound-electricity conversion devices according to the present embodiment.

FIG. 6 is a drawing to show an exemplary construction of the ultrasonic diagnostic apparatus using the array-type ultrasonic transducer constructed by arranging many sound-electricity conversion devices according to the present embodiment. As shown in FIG. 6, the sound-electricity conversion device 9 comprises a plurality of the capacitor cells 8 connected in parallel, the capacitor cells 8 each including the upper and lower electrodes 2, 6. The array-type ultrasonic transducer 10 is constructed by arranging many sound-electricity conversion devices 9. Here, the sound-electricity conversion device 9 functions as a unitary device that independently performs the sound-electricity conversion. The lower electrodes 2 of the sound-electricity conversion device 9 are commonly grounded, while the upper electrodes 6 serve as input and output terminals for the sound-electricity conversion device 9.

Typically, the array-type ultrasonic transducer 10 configured by this many sound-electricity conversion devices is formed on one silicon substrate, i.e., integrated into one chip. The integration into one chip can prevent the fluctuation of characteristics among the sound-electricity conversion devices 9 as well as improve the positional accuracy for each of the individual array-type ultrasonic transducer.

FIG. 6 also shows that in addition to the array-type ultrasonic transducer 10, the ultrasonic diagnostic apparatus 100 comprises; peripheral circuits such as a bias voltage controller 11, a transmission delay/weight selector 12, a transmission beam former 13, a group of switches 14, a transmission/reception sequence controller 15, a reception beam former 20, a filter 21, an envelope signal detector 22, and a scan converter 23; and a peripheral apparatus such as a display 24.

The upper electrodes 6 of the sound-electricity conversion device 9 are connected to the bias voltage controller 11, the transmission beam former 13, and the reception beam former 20 via the group of switches 14. The group of switches 14 configures a drive circuit for the sound-electricity conversion device 9 and controls, for example, the switching of input/output signals. Of these circuits, circuits handling a high voltage such as the group of switches 14 and the transmission beam former 13, in particular, are integrated in the same silicon chip as the above-mentioned array-type ultrasonic transducer 10 integrated into one chip.

The bias voltage controller 11 controls the DC voltage to be applied to the upper electrodes 6 via the group of switches 14. The reception beam former 13 forms a predetermined ultrasonic output signal according to the instruction by the transmission delay/weight selector 12 under the control of the transmission/reception sequence controller 15. The reception beam former 20 reproduces a received ultrasonic signal from a voltage signal of the upper electrode 6, under the control of the transmission/reception sequence controller 15. The received ultrasonic signal reproduced by the reception beam former 20 is input, via the filter 21 and the envelope signal detector 22, to the scan converter 23 which reproduces the signal as a two-dimensional image which is then displayed on the display 24.

Figure 7:
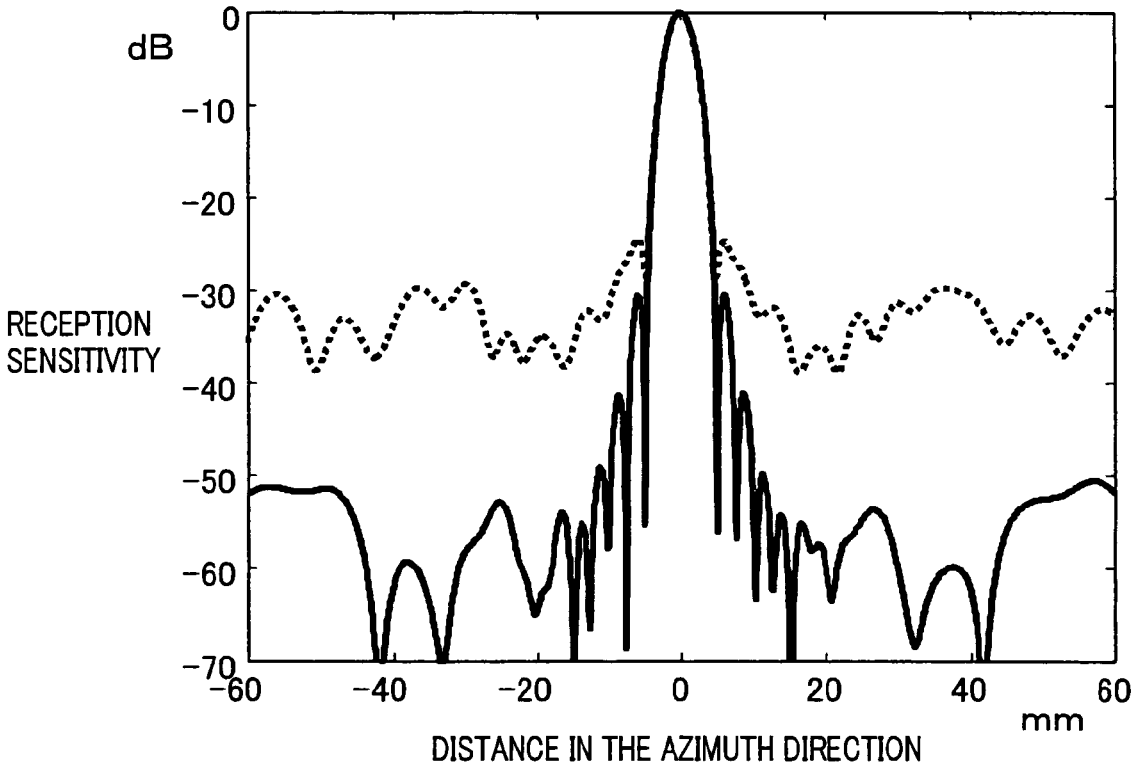
FIG. 7 is a drawing to show an exemplary beam profile of an ultrasonic reception beam formed by the ultrasonic diagnostic apparatus shown in FIG. 6.

FIG. 7 is a drawing to show an exemplary beam profile of an ultrasonic reception beam formed by the ultrasonic diagnostic apparatus as shown in FIG. 6. The array-type ultrasonic transducer 10 of the ultrasonic diagnostic apparatus 100 used at this time is a one-dimension array transducer obtained by arranging in a row sixty-four sound-electricity conversion devices of a 0.25 mm width. The transducer 10 formed a reception beam at a position of 80 mm distance therefrom.

In FIG. 7, the profile indicated in solid line is the reception beam profile formed by the array-type ultrasonic transducer 10 made from the sound-electricity conversion devices 9 of the present embodiment (the electrode short-circuit prevention film 5 being provided with small electric conductivity). The profile indicated in broken line for reference is the reception beam profile formed by the array-type ultrasonic transducer 10 made from the sound-electricity conversion devices 9 using the electrode short-circuit prevention film 5 as an insulator as in the prior art. In either case, a main beam is formed in the order of −6 db and 5 mm width, realizing a similar degree of space resolution.

However, in the latter case, i.e., when the electrode short-circuit prevention film 5 is a typical insulating silicon nitride ($Si_3N_4$) with little electric conductivity, a different amount of electric charge is charged in the electrode short-circuit prevention film 5 for each sound-electricity conversion device 9, resulting in a large fluctuation of transmission/receiving sensitivity for the each sound-electricity conversion device 9. The fluctuation of sensitivity becomes significantly large especially when, for example, the AC voltage component of the electric signal corresponding to a sound pressure is incommensurably smaller than the DC voltage bias component. Further, applying a higher voltage to the extent the upper and lower layers sandwiching the cavity 4 come into contact, in order to increase the receiving sensitivity, will result in more frequent changes in the electric charge amount charged in the electrode short-circuit prevention film 5, and therefore in more frequent drift of sensitivity. Accordingly, it is difficult to correct the fluctuation of sensitivity for each sound-electricity conversion device 9.

Also, under the condition of the DC bias voltage causing the upper and lower layers to come close to contacting to each other, the width of the cavity 4 is considerably decreased because the layers come close to each other. Accordingly, even if the relative fluctuation of the width of the cavity 4 is small for each sound-electricity conversion device when the DC bias voltage is not applied, the relative fluctuation becomes large in operation, i.e., when a DC bias voltage is applied to the extent the upper and lower layers come close to touching to each other. This further causes an even larger fluctuation of the DC bias electric field in the electrode short-circuit prevention film 5, and thereby aggravates the problem of fluctuation and drift of the electric charge amount charged in the electrode short-circuit prevention film 5.

The profile indicated in broken line in FIG. 7 is the reception beam profile obtained when the fluctuation of receiving sensitivity for each sound-electricity conversion device 9 due to the fluctuation of electrification of the electrode short-circuit prevention film 5 has reached ±30%. According to the profile, the sound noise level around the main beam reached about −30 dB on the basis of the main beam at the center. This is an unacceptable level for a reception beam used for an ultrasonic diagnostic apparatus in recent years requiring the display of highly detailed images.

In contrast, the present embodiment eliminates the problem of fluctuation of electrification in the electrode short-circuit prevention film 5 and thereby represses the fluctuation of receiving sensitivity for each sound-electricity conversion device 9, because the electrode short-circuit prevention film 5 of the sound-electricity conversion device 9 is formed of silicon nitride containing a stoichiometrically excessive amount of silicon. The profile indicated in solid line in FIG. 7 is a reception beam profile obtained when the fluctuation of receiving sensitivity for each sound-electricity conversion device 9 is repressed to ±2%. The profile shows that the sound noise level around the main beam is repressed to −50 dB or below, on the basis of the main beam at the center. This noise level of the reception beam is sufficient to bear the use of the ultrasonic diagnostic apparatus 100 of recent years requiring the display of highly detailed images, having a transmission/reception dynamic range of 80-100 dB.

As discussed heretofore, the present embodiment can prevent the fluctuation of electrification in the electrode short-circuit prevention film 5 of the sound-electricity conversion device 9, by forming the electrode short-circuit prevention film 5 with silicon nitride containing a stoichiometrically excessive amount of silicon, providing the film with an electric conductivity with an electrical time constant shorter than 1 second and longer than 10 microseconds. This allows repressing drift of device characteristics of the sound-electricity conversion device 9 and fluctuation of receiving sensitivity, realizing the sound-electricity conversion device 9 with sufficient reception sensitivity for generating an ultrasonic tomographic image and sound-electricity conversion characteristics with sufficiently small fluctuation. Further, by using a large number of the sound-electricity conversion devices 9, the array-type ultrasonic transducer 10 can be realized having sound noise level and transmission/reception sensitivity sufficient for the performance required in the ultrasonic diagnostic apparatus of recent years.

From the aforementioned explanation, those skilled in the art ascertain the essential characteristics of the present invention and can make various modifications and variations to the present invention to adapt it to various usages and conditions without departing from the spirit and scope of the claims.

What is claimed is:

1. A diaphragm-type sound-electricity conversion device for an ultrasonic transducer comprising:

a first electrode formed on a silicon substrate; and a second electrode formed over and opposite to the first electrode, the first and second electrodes sandwiching a cavity, wherein an electrode short-circuit prevention film is formed on the side of the cavity of at least one of the first and second electrodes; and wherein the electrode short-circuit prevention film has a predetermined electric conductivity, and an electrical time constant which determines the electric conductivity is not more than one second and more than ten times of a vibration cycle of a sound wave which is converted by the sound-electricity conversion device.

2. A sound-electricity conversion device as claimed in claim 1, wherein the electrical time constant is not less than 10 micro-seconds.

3. A sound-electricity conversion device as claimed in claim 1, wherein the electrode shirt-circuit prevention film is a silicon nitride film.

4. A sound-electricity conversion device as claimed in claim 3, wherein the silicon nitride film is formed of silicon nitride containing a stoichiometrically excessive amount of silicon.

5. A sound-electricity conversion device as claimed in claim 4, wherein the silicon nitride containing the stoichiometrically excessive amount of silicon has a composition expressed as $(Si_3N_4)$ xSi1-x, wherein $0.7<x<0.95$.

6. An array-type ultrasonic transducer using a plurality of diaphragm-type sound-electricity conversion devices each comprising:

a first electrode formed on a silicon substrate; and a second electrode formed over and opposite to the first electrode, the first and second electrodes sandwiching a cavity, wherein the plurality of the sound-electricity conversion devices are formed and arranged on a silicon substrate;

wherein an electrode short-circuit prevention film is formed on the side of the cavity of at least one of the first and second electrodes constructing the sound-electricity conversion device; and wherein the electrode short-circuit prevention film has a predetermined electric conductivity, and an electrical time constant which determines the electric conductivity is not more than one second and more than ten times of a vibration cycle of a sound wave which is converted by the sound-electricity conversion device.

7. An array-type ultrasonic transducer as claimed in claim 6, wherein at least one part of a drive circuit for the sound-electricity conversion device is formed on the silicon substrate on which is formed the sound-electricity conversion device.

8. An ultrasonic diagnostic apparatus using a diaphragm-type sound-electricity conversion device comprising:

a first electrode formed on a silicon substrate; and a second electrode formed over and opposite to the first electrode, the first and second electrodes sandwiching a cavity, wherein an electrode short-circuit prevention film is formed on the side of the cavity of at least one of the first and second electrodes constructing the sound-electricity conversion device; and wherein the electrode short-circuit prevention film has a predetermined electric conductivity, and an electrical time constant which determines the electric conductivity is not more than one second and more than ten times of a vibration cycle of a sound wave which is converted by the sound-electricity conversion device.

9. An ultrasonic diagnostic apparatus as claimed in claim 8, wherein the apparatus uses a plurality of the sound-electricity conversion devices which are formed and arranged on one silicon substrate.

* * * * *